US008955680B1

(12) United States Patent
Wu Lee

(10) Patent No.: US 8,955,680 B1
(45) Date of Patent: Feb. 17, 2015

(54) CHRISTMAS LIGHT STRING STORAGE STAND

(71) Applicant: Yueh-Feng Wu Lee, Hsinchu (TW)

(72) Inventor: Yueh-Feng Wu Lee, Hsinchu (TW)

( * ) Notice: Subject to any disclaimer, the term of this patent is extended or adjusted under 35 U.S.C. 154(b) by 0 days.

(21) Appl. No.: 14/144,605

(22) Filed: Dec. 31, 2013

(51) Int. Cl.
*B65D 85/42* (2006.01)

(52) U.S. Cl.
CPC ..... *B65D 85/42* (2013.01)
USPC ..... 206/420; 206/419

(58) Field of Classification Search
CPC ..... B65D 85/42; B65D 85/04; F21S 4/003
USPC ..... 206/419, 420, 421, 422, 702; 211/26, 211/26.2
See application file for complete search history.

(56) References Cited

U.S. PATENT DOCUMENTS

| | | | | | |
|---|---|---|---|---|---|
| 4,971,200 | A * | 11/1990 | Huang et al. | ..... | 206/420 |
| 5,168,999 | A * | 12/1992 | Lee et al. | ..... | 206/420 |
| 5,222,602 | A * | 6/1993 | Liao | ..... | 206/420 |
| 5,813,535 | A * | 9/1998 | Tseng | ..... | 206/419 |
| 6,360,899 | B1 * | 3/2002 | Smith et al. | ..... | 211/26 |

* cited by examiner

*Primary Examiner* — David Fidei
(74) *Attorney, Agent, or Firm* — Leong C. Lei

(57) ABSTRACT

The present invention is related to a Christmas light string storage stand including two substrates, each of which is provided with a slot at centerline with an outlet at one end and a recess at both upper and bottom sides, and four corresponding racks in pair arrangement to assemble two substrates together for orderly placing each light bulb of the Christmas light string onto the racks at both upper and bottom sides of the substrates. When the Christmas light string is to be placed for storage after the first time use, the substrates can be assembled through the outlets of the slots toward each other for constituting a three-dimensional stand with a traverse-section of a cross in order to orderly wind the Christmas light string for storage with adequate ventilation to prevent the Christmas light string from damage due to humidity.

3 Claims, 4 Drawing Sheets

CHRISTMAS LIGHT STRING STORAGE STAND

TECHNICAL FIELD OF THE INVENTION

The present invention is related to an improvement on devices for Christmas light string, particularly an improvement on the storage stand of Christmas light string.

DESCRIPTION OF THE PRIOR ART

The Christmas light string storage stand of the present invention is used to place each light bulb and wire of a Christmas light string in an orderly manner before package for sales. Currently this kind of storage stands is of broad variety of appearance and form but they all have one common deficiency despite the different ways of storing the Christmas light string. That is, after taking the Christmas light string out of the storage stand, it becomes very difficult to put the entire Christmas light string back to the storage stand. Even the Christmas light string can be put back to the storage stand, it is unlikely to place the entire Christmas light string in a straight and orderly manner. Further the disorder storage without proper clearance results in poor ventilation that consequently causes easy damage to either the wire or the light bulbs of the Christmas light string due to humidity. Therefore the current storage stands for Christmas light strings are in need of improvement due to improper structure design.

SUMMARY OF THE INVENTION

An objective of the present invention is to provide a complete storage stand utilizing two substrates, each of which is provided with a slot at the centerline of the substrate with an outlet at its one end and a recess at its both upper and bottom sides, and four corresponding racks in order to place both the light bulbs and wire of the Christmas light string after the manufacture in an orderly manner before package for sales. When the Christmas light string is to be placed for storage after being taken out of the package for the first time use, the substrates can be utilized through the outlets of the slots to assemble toward each other for constituting a three-dimensional stand with a traverse-section of a cross in order to wind the Christmas light string in an orderly manner with adequate ventilation to prevent the Christmas light string from damage due to humidity.

DETAILED DESCRIPTION OF THE PREFERRED EMBODIMENTS

Figure 1:
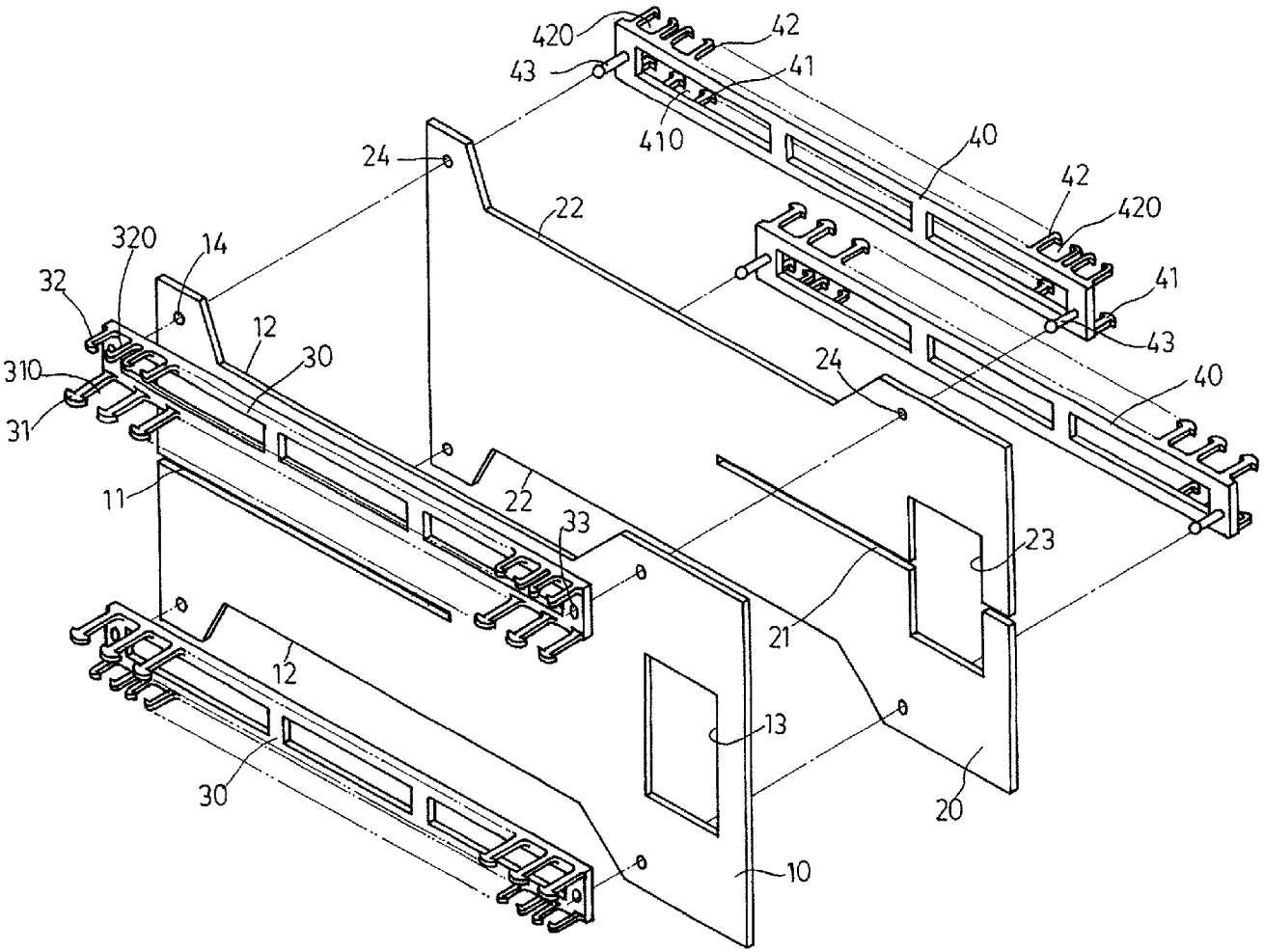
FIG. 1 is a structural explosion diagram of the present invention.
Figure 2:
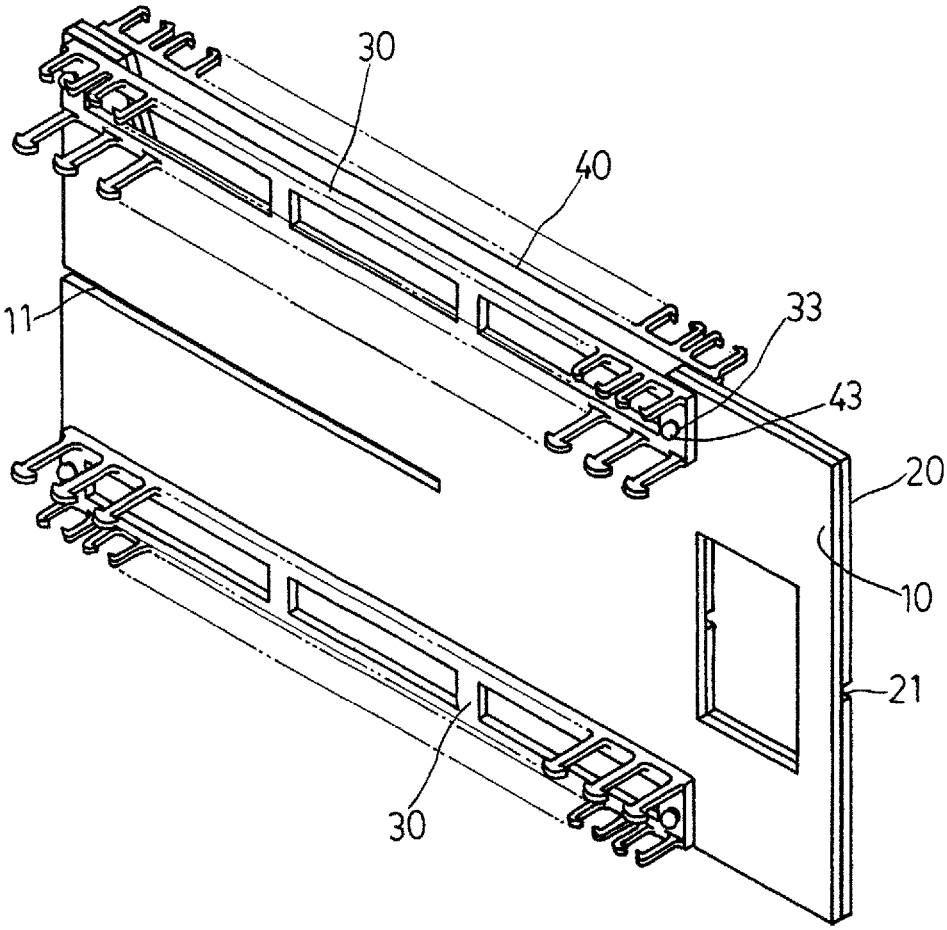
FIG. 2 is an assembly diagram of the present invention.

Firstly please refer FIGS. 1 and 2. The Christmas light string storage stand of the present invention mainly includes two pieces of substrate (10), (20) and four corresponding racks (30), (40) in pair arrangement. The substrate (10) is provided with a slot (11), which is of a length equal to half of the substrate (10) at its centerline with an outlet at left-hand side of the substrate (10), a recess (12), which is at both upper and bottom sides of the substrate (10), an opening (13), which is of a relatively large area at the right-hand side of the substrate (10), and a plurality of holes (14), which are at both ends of the recess (12). The other substrate (20) is provided with a slot (21), which is of a length equal to half of the substrate (20) at its centerline with an outlet at right-hand side of the substrate (20), a recess (22), which is at both upper and bottom sides of the substrate (20), an opening (23), which is the same as the opening (13) of the substrate (10), and a plurality of holes (24), which are at both ends of the recess (22). The rack (30) in pair arrangement is provided with a plurality of big snap post (31) and a plurality of small snap post (32) at equal spacing that a snap slot (310) is thus constituted between the adjacent big snap posts (31) and the other snap slot (320) is also constituted between the adjacent small snap posts (32) as well as a snap hole (33) equally spaced in accordance with the plurality of holes (14) at both ends of the recess (12) on the substrate (10). The other rack (40) in pair arrangement is, similar to the rack (30), provided with a plurality of big snap post (41) and a plurality of small snap post (42) at equal spacing that a snap slot (410) is thus constituted between the adjacent big snap posts (41) and the other snap slot (420) is also constituted between the adjacent small snap posts (42) as well as a snap stud (43) equally spaced in accordance with the plurality of holes (14) at both ends of the recess (12) on the substrate (10). At assembly, the snap stud (43) of the rack (40) is utilized to penetrate through the holes (14), (24) of the substrates (10), (20) respectively and then inserted and secured into the snap hole (33) of the rack (30) so as to assemble the substrate (10) and substrate (20) together.

Figure 3:
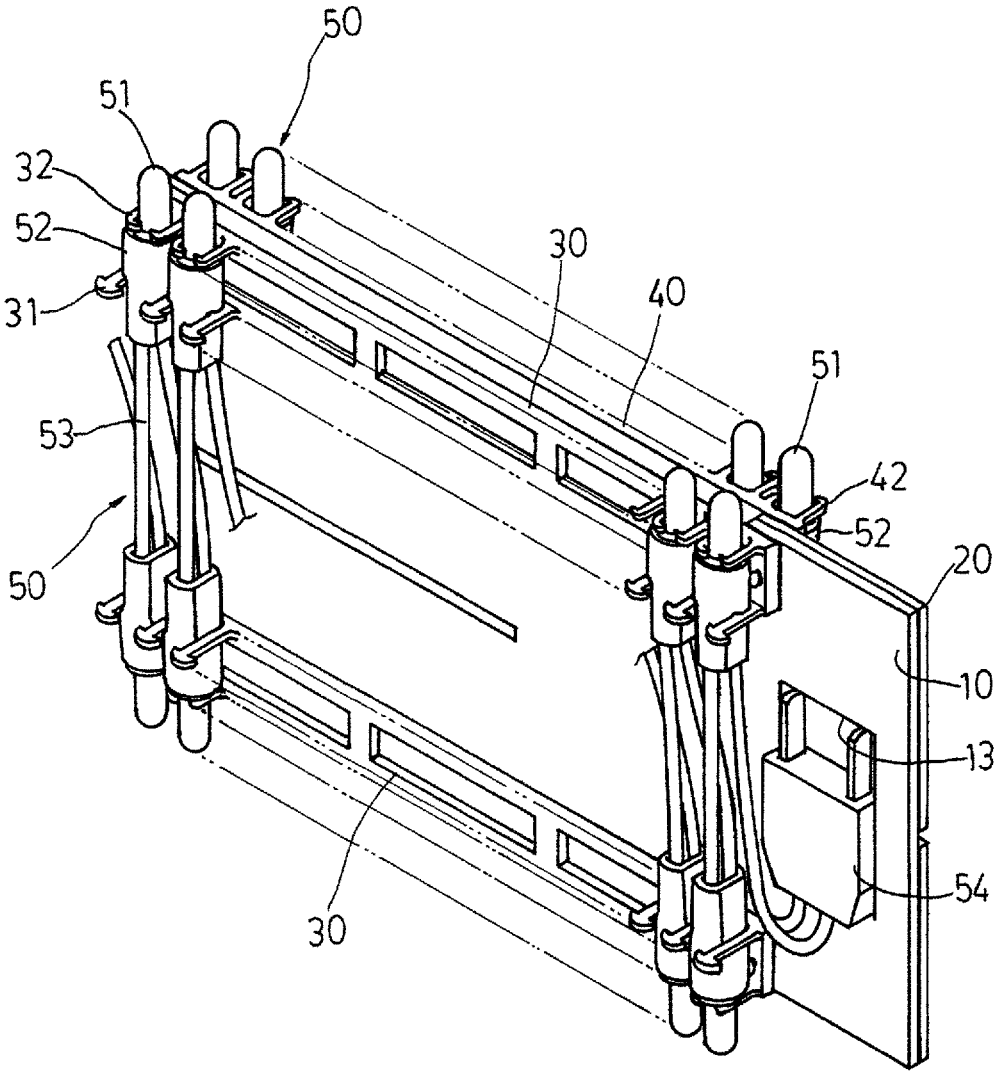
FIG. 3 through 5 is a schematic diagram illustrating various preferred embodiments of the present invention.

As shown in FIG. 3, when the Christmas light string 50 is to be packed for sales out of the manufacture line, each light bulb (51) of the Christmas light string (50) is placed into the snap slot (320), (420) of the racks (30), (40) to be secured by the small snap posts (32) and (42) while the light bulb holder (52) is placed into the snap slot (310), (410) of the racks (30), (40) to be secured by the big snap posts (31) and (41). Hereby the wire (53) of the Christmas light string (50) is thus placed on the substrates (10), (20) between the racks (30), (40) in an orderly manner while the plug (54) of the Christmas light string (50) is placed inside the openings (13), (23) of the substrates (10) and (20). The Christmas light string (50) can be orderly secured on the storage stand through the aforesaid structure and then placed into a package box for delivery.

Figure 4:
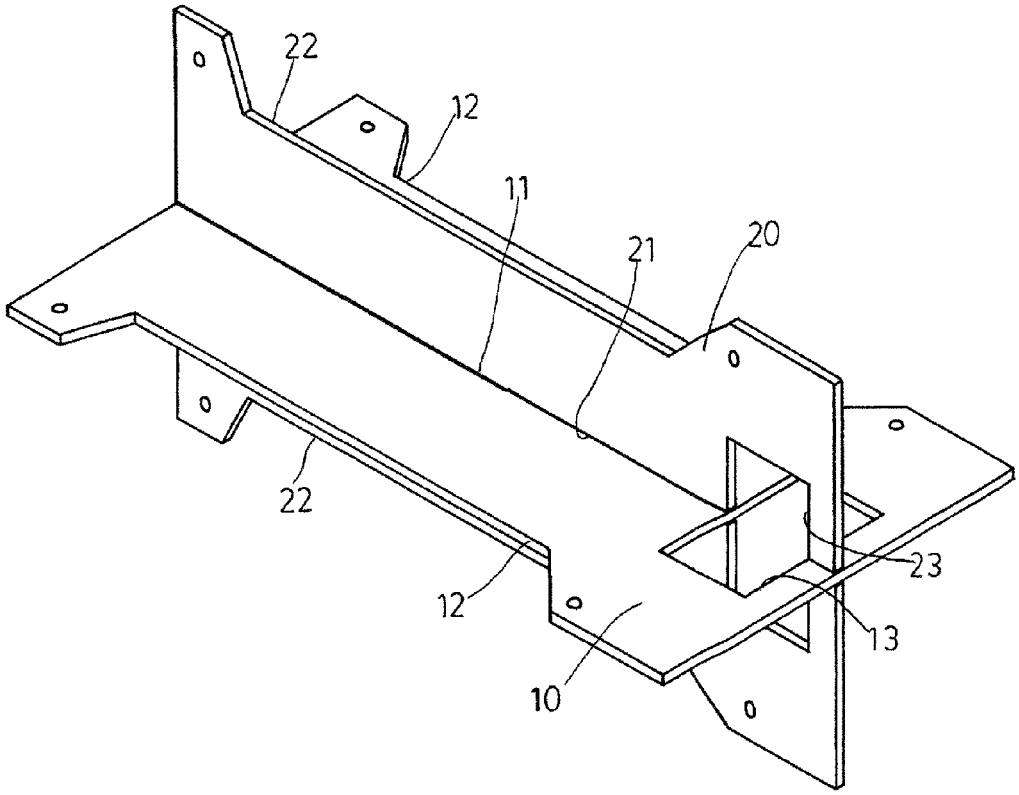
Figure 5:
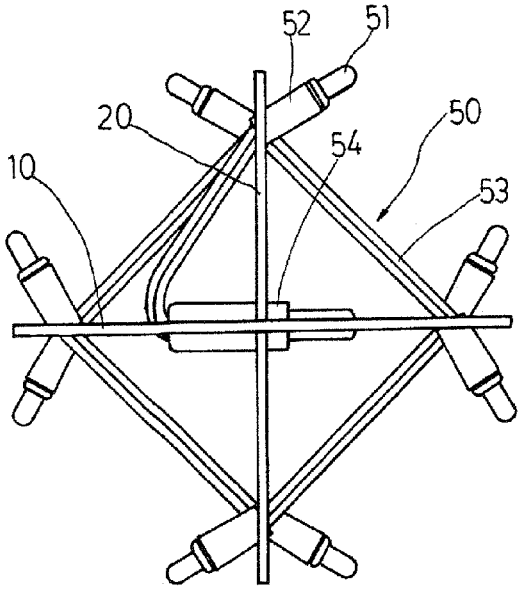

Please refer FIGS. 4 and 5. When the Christmas light string (50) is to be placed for storage after being taken out of the package for the first time use, it only needs to disengage the racks (30) and (40) of the present invention and then separate from the substrates (10) and (20) that are also separated as well. Then the substrates (10), (20) can be utilized through the outlets of the slots (11) and (12) to assemble toward each other for constituting a three-dimensional stand with a traverse-section of a cross in order to wind the Christmas light string (50) around the recesses (12), (22) of the substrates (10) and (20) in an orderly manner while the plug of the Christmas light string (50) can be placed inside the opening (13), (23) of the substrates (10) and (20). Thereby the entire Christmas light string (50) is orderly secured on the three-dimensional stand with a traverse-section of a cross. Further, the three-dimensional stand with a traverse-section of a cross can provide sufficient space for adequate ventilation while the Christmas light string (50) is winded around in order to prevent it from damage due to humidity.

I claim:

1. A Christmas light string storage stand comprising two substrates and four racks as assembled into a complete set, said substrates each provided with a slot of a length equal to half of said substrates at a centerline of said substrates while said slot of said substrates being provided with an outlet at one end of said substrates, a recess on both upper and bottom sides of said substrates, a plurality of holes at both ends of said recess on both upper and bottom sides of said substrates, and an opening at a side of said substrates that said racks attached to both upper and bottom sides of said substrates in two pair arrangement so as to assemble said substrates together and place each light bulb of the Christmas light string by snapping within said racks whereby the Christmas light string being stored on the storage stand in an orderly manner.

2. The Christmas light string storage stand of claim 1, wherein each of said racks is provided with a plurality of posts at equal spacing at both upper and bottom sides for constituting a snap slot between the adjacent snap posts, two of said racks are provided with a snap hole equally spaced in accordance with said holes at both ends of said recess on both upper and bottom sides of said substrates and the other two of said racks are provided with a snap stud equally spaced in accordance with the plurality of holes at both ends of said recess on both upper and bottom sides of said substrates that the snap studs of said racks are utilized to penetrate through said holes on both upper and bottom sides of said substrates and then secured into the snap holes of said racks so as to assemble two said substrates together.

3. The Christmas light string of claim 1, wherein two said substrates can be assembled through said outlet of said slot of said substrates toward each other into a three-dimensional stand with a traverse-section of a cross.

* * * * *